United States Patent [19]

Hertelendy

[11] Patent Number: 4,952,167

[45] Date of Patent: Aug. 28, 1990

[54] ELECTRICAL CONNECTOR

[76] Inventor: Chris Hertelendy, 3364 Newburg Rd., Louisville, Ky. 40218

[21] Appl. No.: 162,177

[22] Filed: Feb. 29, 1988

[51] Int. Cl.[5] ..... H01R 4/24

[52] U.S. Cl. ..... 439/395

[58] Field of Search ..... 439/436–441, 439/723–724, 199, 201, 203–205, 511, 519, 520, 391–396

[56] References Cited

U.S. PATENT DOCUMENTS

| | | | |
|---|---|---|---|
| 3,383,643 | 5/1968 | Nava et al. | 439/724 |
| 3,569,911 | 3/1971 | Bogdanowicz | 439/441 |
| 3,905,667 | 9/1975 | Crimmins et al. | 439/511 |
| 4,059,320 | 11/1977 | Piaget | 439/511 |
| 4,133,594 | 1/1979 | Laverick et al. | 439/439 |
| 4,141,617 | 2/1979 | Freeman | 439/391 |
| 4,192,569 | 3/1980 | Mucci | 439/201 |
| 4,673,233 | 6/1987 | Hertelendy | 439/440 |

FOREIGN PATENT DOCUMENTS

| | | | |
|---|---|---|---|
| 1240573 | 1/1963 | Fed. Rep. of Germany | 439/439 |
| 2057645 | 5/1972 | Fed. Rep. of Germany | 439/436 |
| 2308523 | 9/1973 | Fed. Rep. of Germany | 439/436 |

*Primary Examiner*—Joseph H. McGlynn

*Attorney, Agent, or Firm*—John R. Benefiel

[57] ABSTRACT

A dual lead waterproof connector for reliably connecting end-to-end pairs of wires as to connect blasting cap leads to an electrical source for detonation, in which a resilient metal "C" clip is disposed lengthwise in a longitudinally extending cavity in each of a pair of elongated dielectric connector bodies fixed together and extending side-by-side. The legs of each C-clip are inclined towards each other and terminate adjacent an inside surface of the connector cavity. An unstripped lead to be spliced is inserted through a centering hole in an end plug which is guided to deflect a respective leg to move past the end thereof. The unstripped lead is advanced to bottom the end in a crotch formed by the opposite leg to establish a secondary electrical connection upon pulling on the lead, the lead insulation is sliced through by the edges of a contact slot formed into the end of the C clip leg to reliably establish a low resistance electrical connection to the lead conductor strongly resistant to pull out of the inserted lead. A mass of dielectric silicone fills the interior of each body to insure a waterproof connection. Shunts are provided to insure that stray induced currents cannot be set up to detonate a blasting cap if the connector is connected to a blasting cap during shipment.

12 Claims, 1 Drawing Sheet

ELECTRICAL CONNECTOR

BACKGROUND OF THE INVENTION

This invention concerns electrical connectors, and more particularly waterproof dual lead connectors adapted to allow reliable, high tensile strength field splicing to be made to blasting cap leads.

In conducting blasting operations for mining, excavation, seismic testing and the like, electrically detonated blasting caps are utilized. In many situations, the blasting caps are placed adjacent to charges located in boreholes at relatively great depth, extending vertically into the earth.

In such blasting operations there are typically a large number of charges and blasting caps implaced which all must simultaneously be detonated, or the blast will not produce the desired result and a misfire of any charge requires a very costly reboring of the boreholes and emplacement and wiring of new charges.

Typically, such boreholes are below the water table such as to be flooded, so that the electrical connections thereto must be waterproof.

The leads to the blasting caps are also subjected to significant tensile stresses due to the relatively great depths of the bore holes and rough handling incidental to such operations.

A suitable splice connector for making electrical connections to the blasting cap has not heretofore been provided, which will with sufficient reliability achieve a waterproof connection which is also able to withstand the tensile stresses placed on the spliced connection in handling. For these reasons, the practice has been to provide a large inventory of blasting caps having leads of various lengths to accommodate various borehole depths.

In copending application Ser. No. 912,211, filed on Sept. 25, 1986, now patent 4,673,233, there is disclosed a high tensile strength splice connector in which overlapping lead segments to be spliced are crimped into engagement with a conductive, generally convergent body. It would be advantageous if such high tensile strength, dual lead splice connector was able to be provided not requiring the use of crimping tools.

An important consideration in the design of such connectors is the change in electrical resistance over a range of temperatures or moisture levels. Industry standards require that such changes must not be excessive to insure complete reliability in use for the above reasons.

Accordingly, it is an object of the present invention to provide an electrical connector for making a high tensile strength dual lead splice connection between pairs cf electrical leads in which the electrical resistance does not change substantially over a range of temperature or moisture conditions.

SUMMARY OF THE INVENTION

The present invention comprises an electrical connector which allows a high tensile strength splice connection to be made without the use of tools. The connector includes a dielectric elongated body having a lengthwise extending cavity receiving a conductive C-clip formed of a strip of resilient metal, with inwardly inclined legs each having a slotted terminal edge closely adjacent the inside surface body walls.

The ends of the connector body are closed by sealing inserts of a resilient material, with centering openings directing an inserted lead from each end into the interior of the connector body.

An inserted lead is directed towards the inclined outer surface of a C-clip leg to deflect the leg and be guided into the terminal slotted edge of each leg by contact with the inclined face of the leg. The inserted lead is therefore angled sharply with respect to the terminal edge and may be firmly gripped by the leg edge upon exertion of a pulling force after insertion, penetration of an insulating jacket and establishment of an electrical connection thereby accomplished.

The sharply angled position of an inserted lead insures a high tensile strength self locking frictional grip of an inserted lead between the terminal edge and the inner surface of the connector body cavity.

Insertion of a lead at the opposite end thus completes the splice connector therebetween.

Pairs of the connector bodies are advantageously molded of plastic in a single integral part to provide a dual lead splice connector.

The interior of each body is completely filled with a dielectric waterproof gel, such as silicone grease, a portion of which is displaced upon insertion of each lead to maintain complete occlusion of each connector body cavity.

A shunt clip is also provided to allow safe transport of blasting caps with a connector according to the present invention secured to the blasting cap leads.

This shunt clip comprises a U-shaped conductor having ends insertable in the openings of the opposite insert to move against the adjacent legs of each of the C-clips and establish a shunt connection across the connected leads.

DETAILED DESCRIPTION

Figure 1:
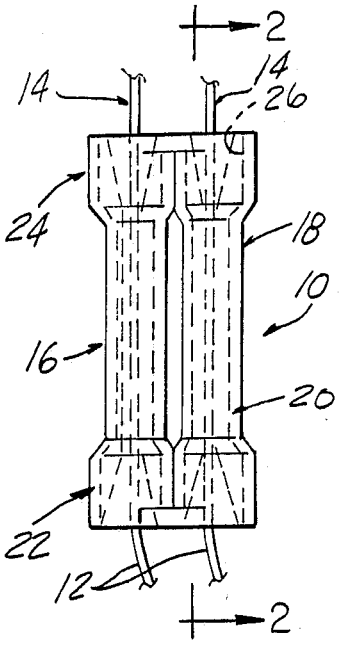
FIG. 1 is a plan view of an electrical connector according to the present invention, with segments of pairs of electrical leads spliced together.

In the following detailed description, certain specific terminology will be employed for the sake of clarity and a particular embodiment described in accordance with the requirements of 35 USC 112, but it is to be understood that the same is not intended to be limiting as the invention is capable of taking many variations within the scope of the appended claims.

Referring to the Drawings, the electrical connector 10 according to the present invention, is adapted to splice a pair of leads 12 and 14 securely together, end-to-end, without the use of crimping tools.

The connector 10 includes a pair of parallel, side-by-side, elongated connector bodies 16 and 18, preferably integral in a single molded part 20 joined at either end as shown in FIG. 1.

The molded part 20 is of a suitable rigid dielectric material, such as a polypropylene plastic.

Figure 2:
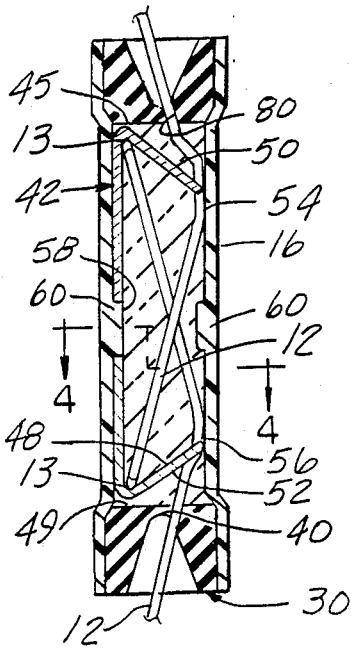
FIG. 2 is a view of the section 2—2 taken in FIG. 1.
Figure 5:
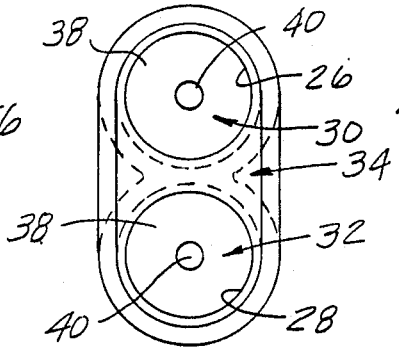
FIG. 5 is an endwise view of the connector shown in FIG. 1.
Figure 6:
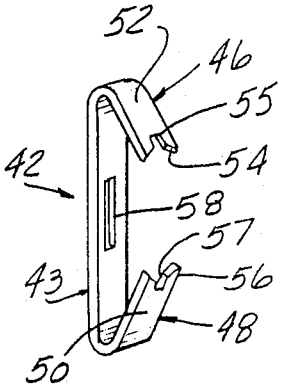
FIG. 6 is a perspective view of the C-clip incorporated in the connector of FIG. 1.

As best seen in FIGS. 2 and 5, each end 22, 24 of the molded part 20 is formed with a pair of round bores 26, 28, aligned with each connector body 16, 18, and which each receive a respective one of a pair of plugs 30, 32 formed of a part of a molded insert 34 received within a recess 36 in ends 22, 24.

Plugs 30, 32 are each formed with conical openings 38 converging to a centered guide hole 40 in the end thereof. Insert 34 is preferably of molded material to allow stretching of the guide holes 40 to accommodate a range of wire gauge sizes.

Figure 4:
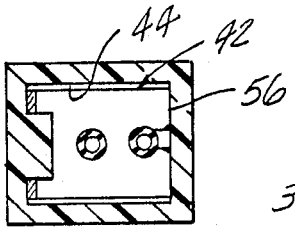
FIG. 4 is a view of the section 4—4 taken in FIG. 2.

Each connector body 16 and 18 is of a hollow rectangular configuration, as best seen in FIG. 4, and has a C-clip 42 sized to be slidably fit into the rectangular lengthwise extending cavity 44 formed therein.

C-clip 42 is constructed of a flat strip of a conductive resilient material, such as spring steel or berylium copper and includes a straight main portion 43 connecting pair of legs 46 and 48 opposite each end which are inclined towards each other to form ramp surfaces 50, 52 facing a respective guide hole 40 at either end. The transverse ends 54, 56 terminate against the inner surface of the cavity 44.

Thus as lead 12 is advanced into the cavity 44 through a guide hole 40, it encounters a ramp surface 50 or 52, and guiding it between the end 54 or 56 of the C-clip leg 46 or 48 respectively.

Figure 3:
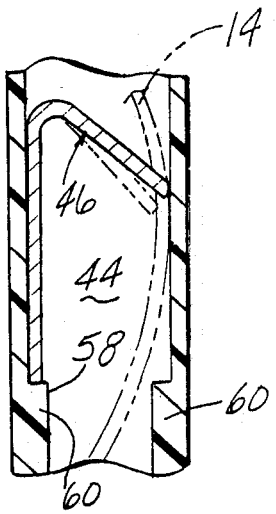
FIG. 3 is an enlarged view of a portion of the section 2—2.

As best seen in FIG. 3, further advance of the lead 14 causes the leg 46 to be resiliently deflected downwardly as shown in phantom to allow the lead to move past the leg edge 56 into the intermediate space of cavity 44. The lead 12 is necessarily inclined since it enters through the centered guide hole 40, and forms a sharp angle with the deflected leg 48.

The tip 13 of the lead 12 or 14 encounters the inside of the opposite leg 46 or 48, inclined at approximately 45° to the main portion 42 to be guided to ultimately bottom against the crotch 45 or 49 of a respective leg 46 or 48, establishing a secondary electrical connection through the clip 42.

The primary electrical connection is established by a slotted contact recess 55, 57 formed in the respective leg 46, 48, the width of the slot is such as to cause the insulation to be penetrated as the lead 12 is drawn thereinto by a slicing action of the parallel opposite edges of a contact recess 55, 57.

Upon pulling of the lead 12, the sides of the contact recess 55 or 57 will bite through the insulation and into contact with the conductor. A strong self locking effect is achieved by the tendency for the leg 46 or 48 to be moved outwardly by pulling forces applied to the lead 12 to lock the same against an inner surface of cavity 44 and trap the lead 12 within the contact. This locking action anchors the leg 46, 48 to resist straightening during seating of the lead 12 in the contact recess 55, 57. The angled orientation of the lead 12 effected by its entrance through the center hole 40 causes a greater deflection of the legs 46, 48 than would otherwise be undergone, to afford greater assurance that contact is maintained between the contact recess 55, 57 and the conductor of the lead 12.

The relatively long length of the lead 12 lying beyond the edge 54, 56 of the respective C-clip leg 46, 48 in addition to establishing a secondary electrical connection, gauges a length of lead such that the insulating jacket is not simply stripped from the conductor when subjected to a pull out tensile force.

Various alternate geometries are possible for the contact recesses 55, 57, such as a sharp vee shape geometry, or rounded or serrated central openings inward from inclined entry edges guiding the lead 12 into the opening.

In order to insure a waterproof connection, the cavity 44 is completely filled with a dielectric gel or grease such as silicone, a small proportion of which is expelled upon insertion of a wire, insuring continued complete occlusion of that space, and waterproofing protection.

The C-clip 42 is formed with a central opening 58 mating with either of opposite molded central features 60 protruding into each cavity 44, to centrally locate the same lengthwise within the cavity 44.

The electrical connector 10 according to the present invention is contemplated as being particularly advantageous when employed to establish splice connections in the field to blasting caps.

Figure 7:
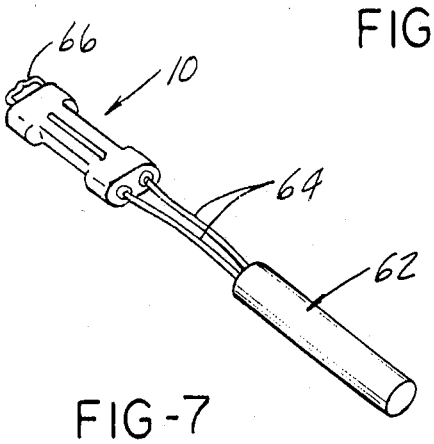
FIG. 7 is a view of the connector of FIG. 1 connecting the leads to a blasting cap and with a shunt clip installed.
Figure 8:
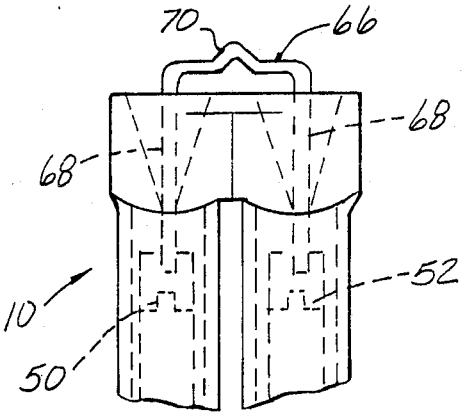
FIG. 8 is an enlarged fragmentary view of the end of the connector shown in FIG. 7 depicting the details of the shunt installed therein.

In such application, it may be preferable to package and ship blasting caps 62 with the leads 64 preattached to one end of a connector 10 according to the present invention, as shown in FIG. 7. In such instance, a shunt 66 is employed comprised of a U-shaped clip of a conductive material having legs 68 (FIG. 8) spaced to be able to be inserted through the free end into contact with the ramping surfaces 50, 52. A suitable pull tab 70 allows easy removal preparatory to installing the connecting leads in the field. This prevents transient induced currents from passing into the blasting cap to thereby prevent accidental explosions.

Thus, it can be appreciated that a reliable electrical connection can be established without the use of tools, and strongly resisting pull out of the leads once inserted and engaged with the C-clip. A range of sizes of wires is easily accommodated, while the connector is simple and able to be manufactured at low cost.

I claim:

1. An electrical connector for establishing a splice connection between electrical leads having an insulating jacket and a conductor core, comprising:

a hollow, elongated connector body of an electrically insulating material having a series of walls defining a cavity therein and having an opening at each end;

a C-clip of a strip of resilient, conductive material disposed in said cavity, said C-clip having a pair of legs, each extending from a respective end of an elongated main portion lying against the inside of one of said walls of said connector body and extending lengthwise within said cavity, each of said legs inclined towards each other and away from a respective adjacent opening of said connector body to form a crotch at either end of said C-clip, each leg having a terminal edge lying at a point closely adjacent the inside of another of said walls of said connector body opposite the inside of said first mentioned wall, a contact recess formed into each terminal edge comprised of a slot having closely spaced opposite edges adapted to slice through said insulating jacket and contact said conductor core as an electrical lead is pulled back after insertion into said connector body to be seated within a contact recess, whereby an electrical lead may be inserted at either end to engage and deflect a respective C-clip leg and move past said terminal edge and thereby be gripped against pullout by the edges of said contact recess sliced into said insulating jacket.

2. The electrical connector according to claim 1 wherein each central slot has sides parallel to said C-clip.

3. The electrical connector according to claim 1 wherein said connector body cavity is rectangular in section and said C-clip is comprised of a flat strip, with said main portion lying against a flat inner surface of said inside of said wall.

4. The electrical connector according to claim 3 further including a plug mounted at each end of said connector body having a centrally located opening sized substantially smaller than said cavity of said connector body, causing an inserted electrical lead to be inclined in order to pass a terminal edge of one of said legs of said C-clip.

5. The electrical connector according to Claim 4 wherein each of said plug is of a resilient material to enable stretching of said opening to accommodate a range of lead sizes.

6. The electrical connector according to Claim 3 wherein said main portion of said C-clip is formed with a feature intermediate the length thereof and wherein said flat surface is formed with a mating feature to locate said C-clip lengthwise within said connector body.

7. The electrical connector according to Claim 3 wherein each leg of said C-clip is inclined at approximately 45° from said main portion, to guide a lead from an oppositely directed lead to one of said crotches.

8. An electrical connector comprising:

a pair of electrically insulating side-by-side elongate connector bodies each having an internal lengthwise extending cavity and an end portion integrally joining each pair of ends of said connector bodies, each end portion being formed with a pair of bore respectively aligned with said lengthwise extending internal cavity;

an insert in each end portion bore, said insert including:

a plug received in each bore, each plug formed with a central opening;

a C-clip disposed in the internal cavity of each of said connector bodies, said C-clip comprised of a strip of electrically conductive material comprising an elongate main portion lying along a surface defining said internal cavity, and a pair of legs integral with said main portion each extending, from a respective end of said main portion, each leg comprising a strip of resilient, electrically conductive material, each leg inclined towards the other to form a crotch at the adjacent end of the main portion, each leg terminating with an edge closely adjacent a surface defining in part said internal cavity opposite said surface against which said main portion is positioned, and, a slotted contact recess extending inwardly from said edge of each leg, whereby insulated leads inserted in said plug openings are each guided to the region adjacent said edge of a leg and allowed to be forced past said leg by deflection thereof and to engage the conductor, said lead drawn within said slotted contact recess.

9. The electrical connector according to claim 8 wherein said connector bodies and end portions thereof are of a stiff plastic and said inserts are of a rubbery electrically insulating material, and said C-clip of a spring metal.

10. The electrical connector according to Claim 8 wherein the connector bodies have rectangularly shaped internal cavities defined by a series of flat internal surfaces.

11. The electrical connector according to Claim 8 wherein the internal cavity of each of said connector bodies is filled with a dielectric waterproof gel.

12. The electrical connector according to Claim 8 further including a shunt clip, comprised of a U-shaped conductive piece having a pair of legs each inserted into an opening of a respective plug at one end of said connector and into contact with a leg of each C-clip.

* * * * *